US006278852B1

(12) United States Patent
Hayashi

(10) Patent No.: US 6,278,852 B1
(45) Date of Patent: Aug. 21, 2001

(54) IMAGE FORMING APPARATUS HAVING ELECTRIC POWER ADJUSTING MEANS

(75) Inventor: Yasuhiro Hayashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/487,606

(22) Filed: Jan. 19, 2000

(30) Foreign Application Priority Data

Jan. 22, 1999 (JP) ..... 11-013885

(51) Int. Cl.[7] ..... G03G 15/20; G03G 21/00

(52) U.S. Cl. ..... 399/88; 219/216; 219/619; 399/69

(58) Field of Search ..... 399/37, 88, 67, 399/69, 328, 320; 219/216, 619, 660

(56) References Cited

U.S. PATENT DOCUMENTS 6,006,051 * 12/1999 Tomita et al. ..... 399/69

FOREIGN PATENT DOCUMENTS 9-114312 * 5/1997 (JP) .
9-160406 * 6/1997 (JP) .

* cited by examiner

*Primary Examiner*—Sophia S. Chen
(74) *Attorney, Agent, or Firm*—Fitzpatrick, Cella, Harper & Scinto

(57) ABSTRACT

An image forming apparatus has an image forming unit for forming an image on a recording material, an image fixing device for fixing the image onto the recording material, the image fixing device having an electric conductor, a coil for inducing an eddy current in the electric conductor, and a power supply for supplying an alternating current to the coil. An electric power adjusting control is provided for adjusting a maximum electric power to be supplied to the coil.

3 Claims, 6 Drawing Sheets

IMAGE FORMING APPARATUS HAVING ELECTRIC POWER ADJUSTING MEANS

BACKGROUND OF THE INVENTION

1. Field of the Invention

This invention relates to an image forming apparatus such as a copier or a printer, and particularly to an image forming apparatus having a fixing device for fixing an unfixed image on a recording material.

2. Related Background Art

An image forming apparatus using the electrophotographic method usually has a fixing device for pinching and conveying a transfer material and a toner comprising resin, a magnetic material, a coloring material, etc. and electrostatically borne on the sheet material by the pressure contact portion (nip portion) between a fixing roller and a pressing roller brought into pressure contact with each other and being rotated and applying heat and pressure to them to thereby melt and fix the toner, and most of electric power consumed by the image forming apparatus is used by the fixing device.

In almost all of image forming apparatuses, maximum electric power usable by an entire image forming apparatus is set, and during the starting of the image forming apparatus, predetermined electric power of 70% or more of the maximum electric power is inputted to the fixing device dominating the apparatus starting time, and the other portions of the image forming apparatus are started by electric power within the remaining 30% and thus, the apparatus becomes ready for the image forming operation.

When the image forming operation is entered, the preset maximum electric power usable by the image forming apparatus, minus maximum electric power which may be consumed by the other portions than the fixing device, for example, an image forming portion, a scanner portion, a driving portion, an accessory portion, etc. at a time is maximum electric power usable by the fixing device during the image forming operation, and the value thereof is always constant.

However, if the maximum electric power usable by the fixing device when in the above-described image forming apparatus according to the prior art, a great deal of continuous printing is effected, for example, under low temperature environment is always constant, the temperature of the fixing roller will greatly fall from a target temperature due to the deficiency of electric power as shown in FIG. 3 of the accompanying drawings to thereby cause bad fixing, or in order to avoid it, the printing speed must be reduced.

For example, description will now be made by the use of a fixing device using a halogen lamp as a heating source.

The reference numeral 100 in FIG. 5 of the accompanying drawings designates a halogen heater, and a CPU 101 ON/OFF-controls electric power supplied from a power source outlet by a heater driver 104 having a switch on the basis of a temperature detected by a thermistor 103 for detecting the temperature of a fixing roller 105. The reference numeral 106 denotes a thermoswitch for preventing the excessive temperature rise of the halogen lamp, and the reference numeral 107 designates a motor driver for driving the fixing roller.

In the fixing device using the halogen lamp as described above, the electric power from the outlet is directly supplied to the halogen lamp. The heat generating amount of the halogen lamp per unit time is determined by only the ratio between the ON time and the OFF time of the switch 104 provided in an electric power supply line, and maximum suppliable electric power is constant when the ON time is 100%.

It is the merit of the fixing device using the halogen lamp that although the maximum suppliable electric power cannot be changed, it need not have a power source and therefore the cost thereof is low.

Accordingly, when as previously described, more electric power is required in such a situation as a great deal of printing under low temperature environment, for example, a fixing device like the fixing device using the halogen lamp has had only such a countermeasure as interrupting the printing or reducing the printing speed.

SUMMARY OF THE INVENTION

The present invention has been made in view of the above-noted problem and an object thereof is to provide an image forming apparatus which fully makes the most of the capability of the apparatus.

Another object of the present invention is to provide an image forming apparatus which can carry out the maximum printing process within the range of a predetermined power consumption amount.

Still another object of the present invention is to provide an image forming apparatus designed such that if there is electric power not used in the apparatus, the electric power can be used as much as possible by a fixing device.

Yet still another object of the present invention is to provide an image forming apparatus comprising:

- image forming means for forming an image on a recording material;
- image fixing means for fixing the image onto the recording material, the image fixing means including an electric conductor, a coil for inducing an eddy current in the electric conductor, and a power supply for supplying an alternating current to the coil; and
- electric power adjusting means for adjusting maximum electric power the power supply can supply to the coil.

Further objects of the present invention will become apparent from the following detailed description when read with reference to the accompanying drawings.

DETAILED DESCRIPTION OF THE PREFERRED EMBODIMENTS

Figure 4:
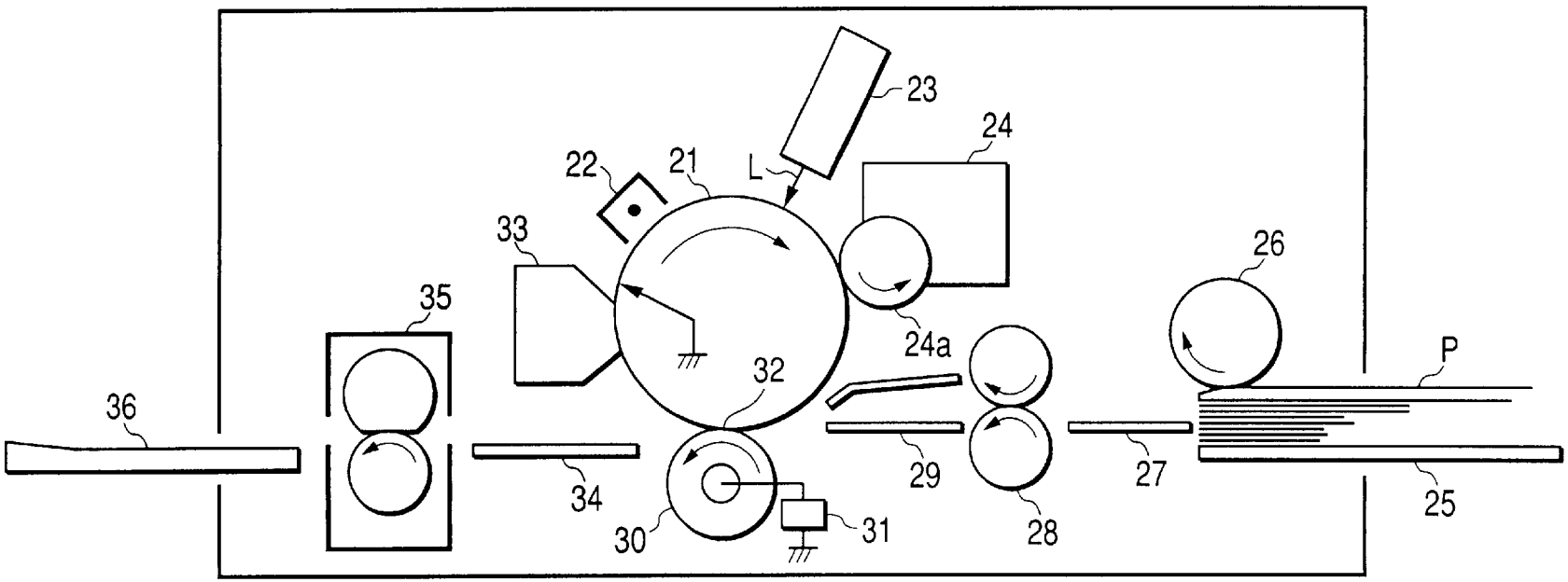
FIG. 4 is a simple cross-sectional view for illustrating the image forming apparatus of the present invention.
Figure 5:
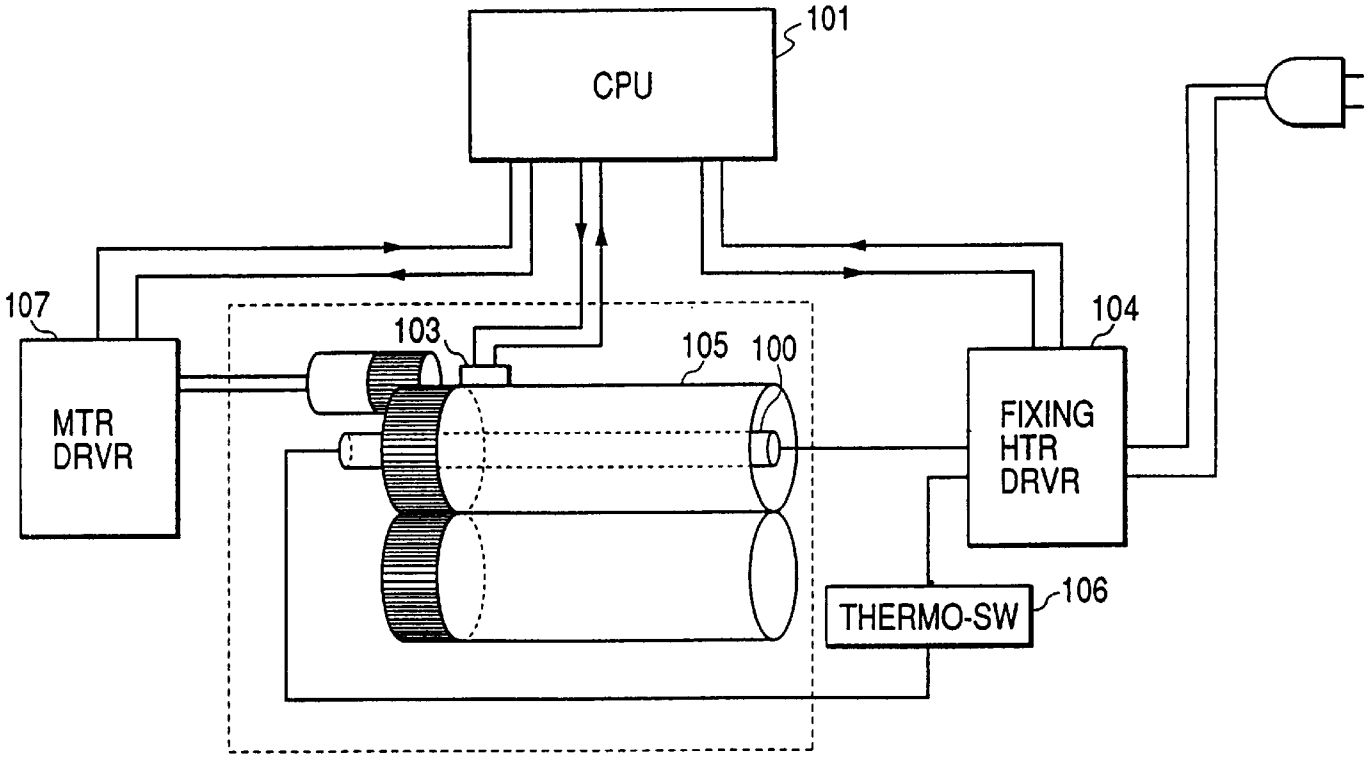
FIG. 5 schematically shows the construction of the fixing device using the halogen heater.

FIG. 4 schematically shows the construction of an example of an image forming apparatus using a heating device of the electromagnetic induction heating type as an image heating and fixing device 35. This image forming apparatus is a laser beam printer utilizing the electrophotographic process.

The reference numeral 21 designates a rotary drum type electrophotographic photosensitive member (hereinafter referred to as the photosensitive drum) as an image bearing member. This photosensitive drum 21 is rotatively driven in the clockwise direction of arrow at a predetermined peripheral speed (process speed), and in the rotating process thereof, it is uniformly charged to predetermined minus dark potential $V_D$ by a primary charging device 22.

The reference numeral 23 denotes a laser beam scanner which outputs a laser beam L modulated correspondingly to the time-serial electric digital pixel signal of desired image information inputted from a host apparatus, not shown, such as an image reading apparatus, a word processor or a computer, and the surface of the photosensitive drum 21 uniformly charged to minus by the primary charging device 22 as previously described is scanned by and exposed to the laser beam, whereby the exposed portion becomes small in its absolute potential value and assumes light potential $V_L$, and an electrostatic latent image corresponding to the desired image information is formed on the surface of the rotary photosensitive drum 21.

The latent image is reversal-developed with powder toner (the toner adheres to the laser-exposed portion $V_L$) charged to minus by a developing device 24 and is visualized.

The developing device 24 has a rotatively driven developing sleeve 24*a*, and the outer peripheral surface of the sleeve is coated with a thin layer of toner having minus charges and is opposed to the surface of the photosensitive drum 21, and a developing bias voltage $V_{DC}$ of which the absolute value is smaller than the dark potential $V_D$ of the photosensitive drum 21 and greater than the light potential $V_L$ of the photosensitive drum 21 is applied to the sleeve 24*a*, whereby the toner on the sleeve 24*a* is transferred to only the portion of the light potential $V_L$ of the photosensitive drum 21 and the latent image is visualized (reversal-developed).

On the other hand, recording materials P stacked and set on a sheet feeding tray 25 are fed one by one by a sheet feeding roller 26 and are conveyed via a conveying guide 27, a pair of registration rollers 28 and a pre-transfer guide 29 to the nip portion (transfer portion) 32 between the photosensitive drum 21 and a transfer roller 30 as a transfer member bearing against the photosensitive drum 21 and having a transfer bias applied thereto by a power source 31, at appropriate timing synchronized with the rotation of the photosensitive drum 21, and the toner image on the surface of the photosensitive drum 21 is sequentially transferred to the thus fed recording material P. The resistance value of the transfer roller 30 as the transfer member may suitably be of the order of $10^8$ to $10^9$ Ωm.

The recording material P which has passed through the transfer portion 32 is separated from the surface of the photosensitive drum 21 and is introduced to a fixing device 35 by a conveying guide 34, whereby the recording material P has the transferred toner image thereon fixed, and is outputted as an image forming article (print) to a sheet discharge tray 36. After the separation of the recording material, the surface of the photosensitive drum 21 has any residual substance thereon such as untransferred toner removed by a cleaning device 33 and is cleaned and is repetitively used for image formation.

Figure 1:
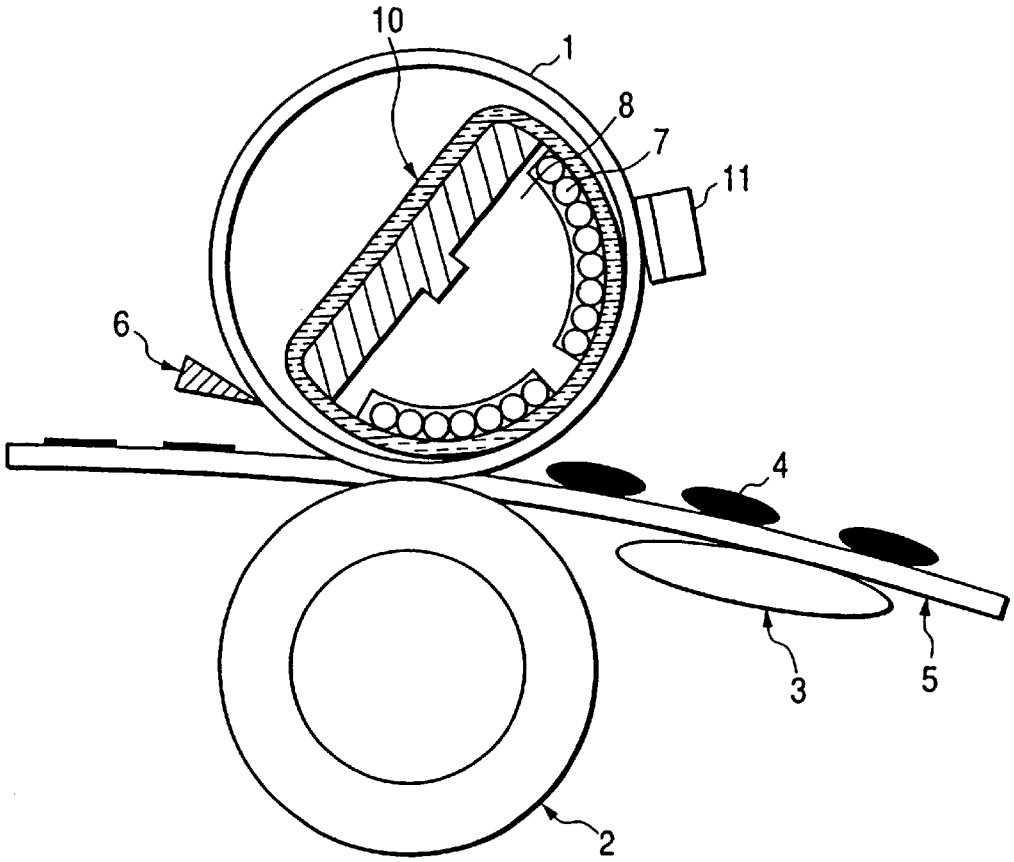
FIG. 1 is a cross-sectional view of a fixing device of the induction heating type used in the image forming apparatus of the present invention.

FIG. 1 is a typical cross-sectional view of the fixing means of the image forming apparatus of the present invention.

A fixing roller 1 is an iron mandrel cylinder having an outer diameter of 32 [mm] and a thickness of 0.5 [mm], and may be provided with a layer of PTFE 10 to 50 [μm] or PFA 10 to 50 [μm] in order to enhance the releasing property of the surface thereof.

Also, as other material of the fixing roller, use may be made of a magnetic material (magnetic metal) such as magnetic stainless steel having relatively high magnetic permeability $\mu$ and suitable resistivity $\rho$.

A pressing roller 2 has an Si rubber layer having a thickness of 5 [mm] on the outer periphery of an iron mandrel having an outer diameter of 20 [mm], and like the fixing roller 1, it may be provided with a layer of PTFE 10 to 100 [μm] or PFA 10 to 100 [μm] in order to enhance the releasing property of the surface thereof, and the total outer diameter thereof is about 30 [mm].

The fixing roller 1 and the pressing roller 2 are rotatably supported, and only the fixing roller 1 is driven.

The pressing roller 2 is in pressure contact with the surface of the fixing roller 1, and is disposed so as to be driven and rotated by the frictional force in the pressure contact portion (nip portion). Also, the pressing roller 2 is pressed in the direction of the rotary shaft of the fixing roller 1 by a mechanism, not shown, using a spring or the like.

The pressing roller 2 is loaded with about 20 [kg], and in that case, the width of the pressure contact portion (nip width) is about 4 [mm]. In some cases, however, the load may be varied to thereby change the nip width.

A conveying guide 3 is disposed at a location for guiding a sheet material 5 conveyed while bearing an unfixed toner image 4 thereon to the nip portion between the fixing roller 1 and the pressing roller 2.

A separation claw 6 is disposed so as to abut against the surface of the fixing roller 1, and is for forcibly separating the sheet material 5 to thereby prevent jam when the sheet material 5 sticks on the fixing roller 1 after it has passed through the nip portion.

An exciting coil 7 comprises 20 to 150 insulatively covered conductors having an outer diameter of 0.15 to 0.50 [mm] made into a litz, and is connected to a high frequency converter, not shown, and an alternating current of 10 to 100 [kHz] is applied thereto, and electric power up to the order of 1500 [W] is supplied thereto.

Further, with a case where the exciting coil 7 has risen in temperature taken into account, a heat resisting material is used as the insulative covering. A magnetic field induced by the alternating current flowing to the exciting coil 7 flows an eddy current to the vicinity of the inner surface of the fixing roller which is electrically conductive to thereby generate Joule heat. To increase this generated heat, it is preferable to make the current amplitude of the alternating current great, and this becomes possible by decreasing the number of turns of the exciting coil 7, but at the same time, the amount of generated heat by the electrical resistance of the exciting coil 7 is also increased and therefore, in the present embodiment, the number of turns of the exciting coil 7 is eight.

A magnetic material core 8 may preferably be of high magnetic permeability and low loss, and is used to increase the efficiency of a magnetic circuit and to intercept magnetism.

The exciting coil 7 and the magnetic material core 8 are held on the longitudinally opposite end portions of the fixing roller by a holder 9 made of aluminum, and are covered with an insulative heat-shrinkable tube 10 and are made into an exciting coil and magnetic material core unit.

Also, the exciting coil and magnetic core unit is inclinedly disposed as shown in FIG. 1 to efficiently supply heat to the toner image 4 and the sheet material 5 by disposing the heat generating portion immediately before the nip portion because the electrically conductive layer of the fixing roller to which the exciting coil 7 is opposed locally generates heat.

A temperature sensor 11 is disposed so as to abut against the surface of that portion of the fixing roller 1 which locally generates heat, and the supply of electric power to the exciting coil 7 is increased or decreased on the basis of the detection signal of the temperature sensor 11, whereby the surface temperature of the fixing roller 1 is automatically controlled so as to become a predetermined constant temperature.

Figure 6:
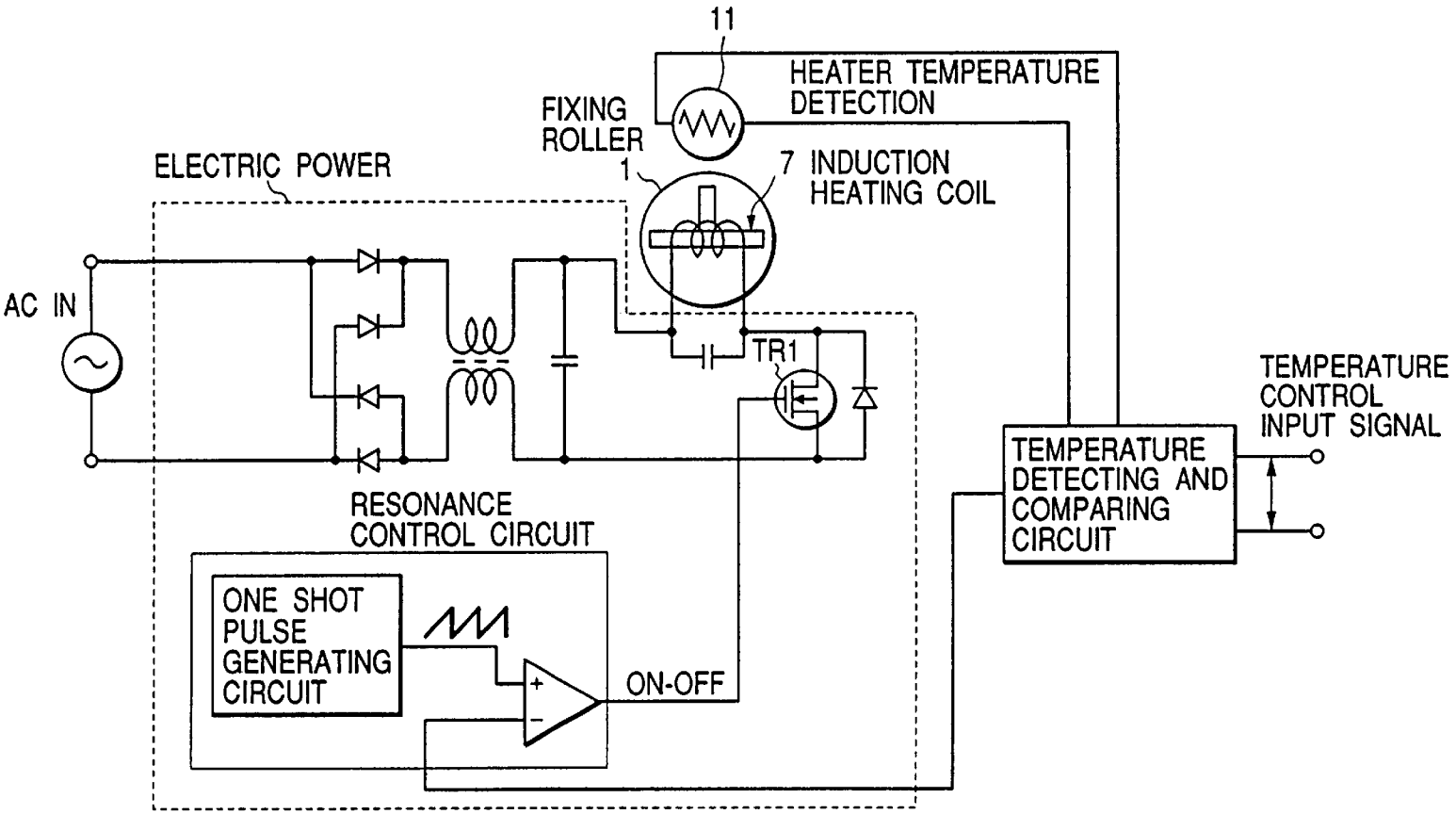
FIG. 6 shows the power supply circuit and temperature control circuit of a fixing device according to an embodiment of the present invention.

FIG. 6 shows the power supply circuit and temperature control circuit of the fixing device in the present embodiment. A high frequency current supplied to the coil 7 by the power supply is adjusted by switching TR1 in the power supply in conformity with the detected temperature by the thermistor 11. Electric power adjusting means for adjusting the supply of electric power to the fixing means will now be described with reference to FIG. 2.

Electric power W(t) used in portions except the fixing means is detected by electric power detecting means, and the preset maximum electric power $W_{MAX}$ usable by the entire image forming apparatus, minus the electric power W(t) used in the portions except the fixing means is defined as the maximum electric power $W_{FMAX}$ usable in the fixing means.

The electric power detecting means detects the electric power W(t) used in the portions except the fixing means, and on the basis of the result of this detection, the electric power adjusting means adjusts the maximum electric power $W_{MAX}$ preset for the entire image forming apparatus, minus the electric power W(t), and supplies it to the fixing means as the maximum electric power $W_{FMAX}$ usable in the fixing means.

In such a case, although within the maximum usable electric power $W_{MAX}$ preset for the entire image forming apparatus, the remaining electric power used in the portions except the fixing means can be used as the maximum electric power $W_{FMAX}$ usable by the fixing means and therefore, the bad fixing by the temperature drop of the fixing roller caused as by the deficiency of the electric power supplied to the fixing means can be prevented.

Figure 2:
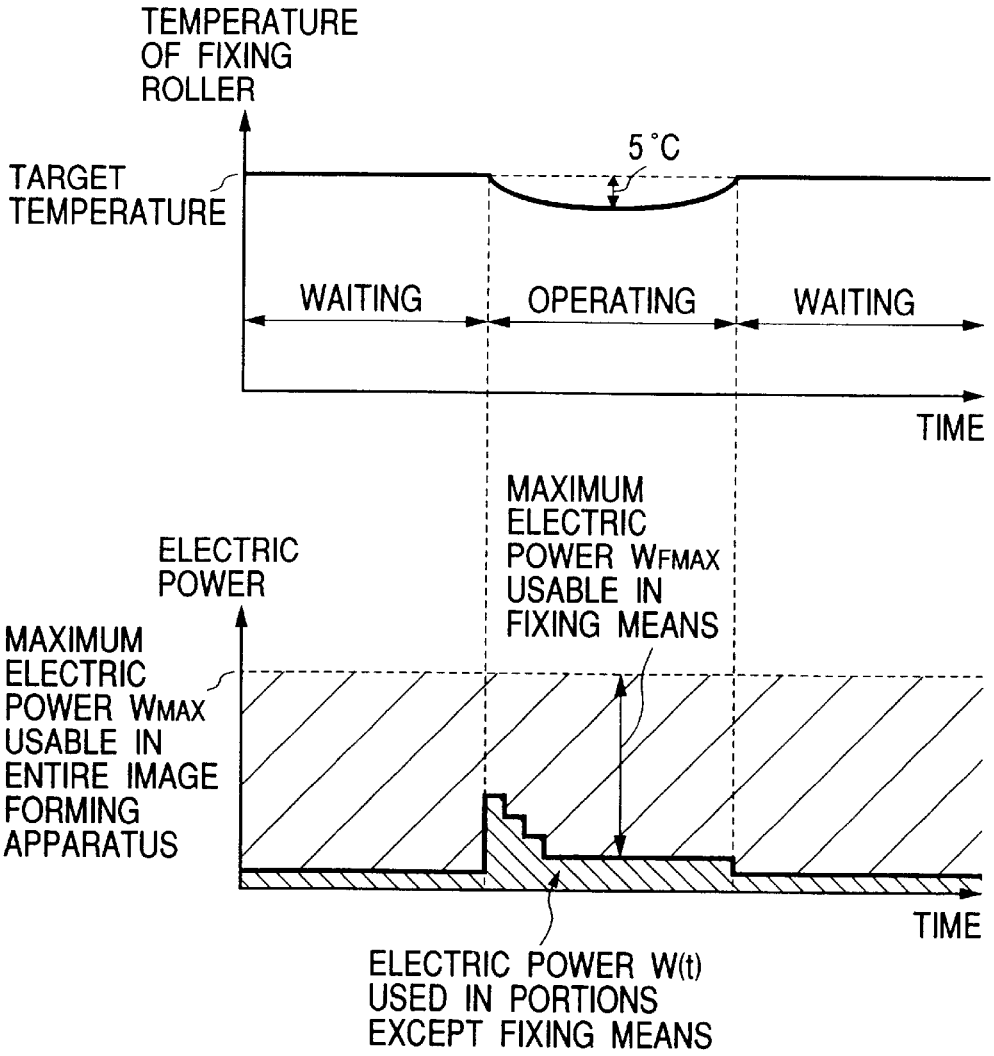
FIG. 2 represents the relations among a variation in the surface temperature of a fixing roller when the present invention is used, electric power used in portions except the fixing device and electric power used in the fixing device.
Figure 3:
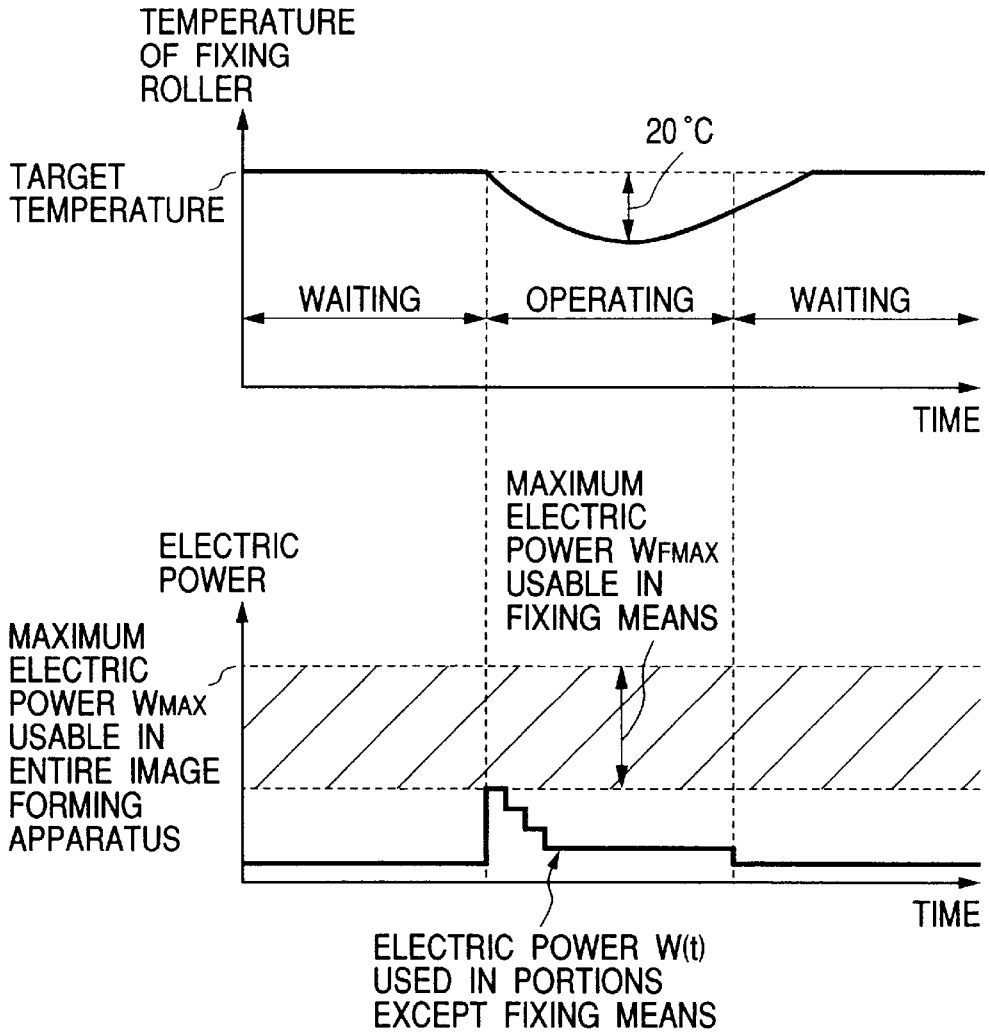
FIG. 3 represents the relations among a variation in the surface temperature of the fixing roller of a fixing device using a halogen heater, electric power used in portions except the fixing device and electric power used in the fixing device.

Accordingly, the electric power adjusting means adjusts the remaining electric power being used in the portions except the fixing means and supplies it to the fixing means, whereby relative to the temperature drop 20° C. when as shown in FIG. 3, the electric power usable in the fixing means is constant, the temperature drop becomes 5° C. as shown in FIG. 2.

As described above, the temperature drop of the fixing roller becomes small, whereby the fixing performance becomes constant.

Also, the maximum electric power $W_{FMAX}$ usable in the fixing means is not adjusted only during the image forming operation, but may be adjustable also during the starting of the image forming apparatus, and in such case, the starting time of the image forming apparatus can be shortened by about 20%.

In the fixing means of the induction heating type, the electric power-heat conversion efficiency is substantially constant even if the input electric power is varied, and it never happens that as in the fixing means having a halogen lamp as a heating source, the electric power-heat conversion efficiency is greatly varied when the input electric power is varied.

The present invention is not restricted to the above-described embodiment, but covers all modifications within the technical idea of the invention.

What is claimed is:

1. An image forming apparatus comprising:

image forming means for forming an image on a recording material;

image fixing means for fixing the image onto the recording material, said image fixing means including an electric conductor, a coil for inducing an eddy current in said electric conductor, and a power supply for supplying an alternating current to said coil; and electric power adjusting means for adjusting a maximum electric power to be supplied to said coil.

2. An image forming apparatus according to claim 1, wherein said electric power adjusting means adjusts so that said power supply can supply an electric power which is made by subtracting an electric power being used in portions other than said image fixing means from maximum electric power usable by the entire apparatus.

3. An image forming apparatus according to claim 1, further comprising electric power detecting means for detecting the electric power used in portions other than said image fixing means, wherein said electric power adjusting means adjusts the maximum electric power said power supply can supply in conformity with the output of said electric power detecting means.

* * * * *